US006098520A

United States Patent [19]

Terauchi

[11] Patent Number: 6,098,520

[45] Date of Patent: Aug. 8, 2000

[54] SWASH PLATE COMPRESSOR IN WHICH A SWASH PLATE HAS A SLIDING SURFACE NON-PARALLEL TO A REFERENCE SURFACE THEREOF

[75] Inventor: Kiyoshi Terauchi, Isesaki, Japan

[73] Assignee: Sanden Corporation, Gunma, Japan

[21] Appl. No.: 09/104,223

[22] Filed: Jun. 25, 1998

[30] Foreign Application Priority Data

Jun. 30, 1997 [JP] Japan ..... 9-187171

[51] Int. Cl.[7] ..... F01B 3/00

[52] U.S. Cl. ..... 92/71; 74/60

[58] Field of Search ..... 91/499; 92/71; 74/60

[56] References Cited

U.S. PATENT DOCUMENTS 4,168,632 9/1979 Fokker ..... 74/60
5,483,867 1/1996 Ikeda et al. ..... 92/71

*Primary Examiner*—Edward K. Look
*Assistant Examiner*—Thomas E. Lazo
*Attorney, Agent, or Firm*—Baker Botts L.L.P.

[57] ABSTRACT

A swash plate compressor is for carrying out a compressing operation by converting a rotational force of a swash plate into a reciprocating motion of a piston via a sliding member which is held to the piston. The swash plate extends along a reference plane and has a sliding surface which faces on the sliding member with rotation of the swash plate. The sliding surface is non-parallel to the reference plane. The sliding surface may have a conical shape or a curved surface shape.

6 Claims, 3 Drawing Sheets

SWASH PLATE COMPRESSOR IN WHICH A SWASH PLATE HAS A SLIDING SURFACE NON-PARALLEL TO A REFERENCE SURFACE THEREOF

BACKGROUND OF THE INVENTION

The present invention relates to a swash plate compressor which is suitable for use in a vehicle air conditioner.

A swash plate compressor of the type carries out a compressing operation by converting a rotational force of a swash plate into a reciprocating motion of a piston via a sliding member held to the piston. In the swash plate compressor, the swash plate extends along a reference plane and has a sliding surface which faces on the sliding member with rotation of the swash plate in the manner known in the art. Accordingly, it is required to lubricate between the sliding member and the swash plate.

In swash plate compressors, for use in vehicle air conditioners, whose reduction in size and weight have been required, the supply of lubricating oil to the sliding members is reduced during low-speed operations of vehicle engines. Accordingly, there have been proposed various lubrication mechanisms for preventing load increases and burning of the sliding members.

For example, Japanese Examined Patent Publication No. 63-27554 has proposed a technique wherein surfaces of sliding members contacting a swash plate are formed into gradually or gently curved surfaces to obtain gaps therebetween so that oil films are held in the gaps to improve lubrication characteristics for the sliding members. In the technique, the surface of the sliding member slidably contacting the swash plate is constituted of a plurality of curved surfaces including a gently convex curved surface with a large radius of curvature obtained by numerically defining heights thereof setting its central portion as the apex, and round portions smoothly continuous with the convex curved surface. It is known that the convex curved surface and the round portions are essential and the relationship thereof influences the lubrication efficiency.

In the foregoing conventional technique, however, the lubrication effect for the sliding members is insufficient and unstable. Specifically, since the shape and roughness of the convex curved surface and the round portions largely influence the lubrication, it is difficult to accomplish the performance as designed.

Further, since the surface of the sliding member slidably contacting the swash plate is constituted of the curved surfaces having different curvatures, the formation process thereof is not simple. Moreover, since the lubrication effect delicately changes depending on the curvatures of the curved surfaces as described above, the laborious process and the accurate technique are required.

Since it is complicate to form the sliding surface by two curves with different curvatures like the foregoing sliding member, much difficulty is encountered from a technical point of view.

Particularly, since it is necessary to manufacture a plurality of relatively small sliding members each requiring accuracy, much time and effort for ensuring dimensional accuracy are required. Thus, not a small burden is required on quality control, which leads to an increase in cost.

As described above, it is difficult to achieve the lubrication effect for the sliding members as designed. For maintaining the delicate gaps, the maintenance including cleaning is required on a constant basis.

SUMMARY OF THE INVENTION

It is therefore an object of the present invention to provide an improved swash plate compressor having a lubrication mechanism for a sliding member, particularly suitable for a vehicle air conditioner.

Other objects of the present invention will become clear as the description proceeds.

A swash plate compressor to which the present invention is applicable is for carrying out a compressing operation by converting a rotational force of a swash plate into a reciprocating motion of a piston via a sliding member which is held to the piston. The swash plate extends along a reference plane and has a sliding surface hich faces on the sliding member with rotation of the swash plate. The sliding surface is non-parallel to the reference plane.

DESCRIPTION OF THE PREFERRED EMBODIMENTS

Figure 1:
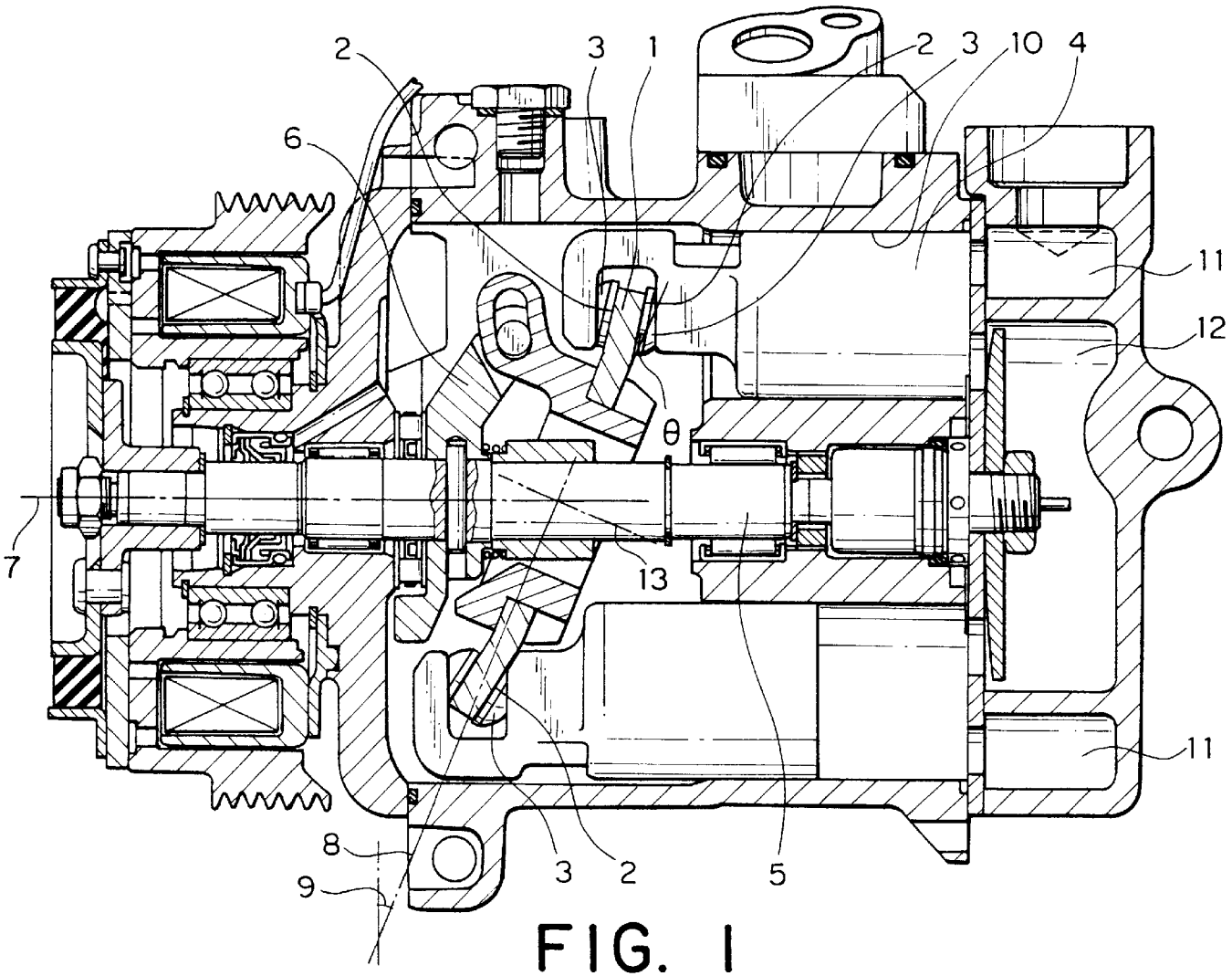
FIG. 1 is a longitudinal sectional view of a swash plate compressor according to a first preferred embodiment of the present invention.

Referring to FIG. 1, description will be made as regards a swash plate compressor according to a first preferred embodiment of the present invention. The swash plate compressor is for carrying out a compressing operation by converting a rotational force of a swash plate 1 into a reciprocating motion of a plurality of pistons 4 via sliding members 3. The swash plate 1 is mounted on a drive shaft 5 along with a rotor 6 fixed to the drive shaft 5. The drive shaft 5 is rotatable around a rotation axis 7 and driven by a vehicle engine in the manner known in the art. The swash plate 1 extends along a reference plane 8 which is usually inclined relative to a plane perpendicular to the rotation axis 7. In other words, the swash plate 1 has an inclination 9 which are variable to make the swash plate compressor have variable displacement in the manner known in the art.

The sliding members 3 are held to the pistons 4 and interposed between the swash plate 1 and each of pistons 4. In the manner known in the art, the sliding members 3 are used for causing the pistons 4 to reciprocate in cylinders 10 when the swash plate 1 is rotated around the rotation axis 7 together with the drive shaft 5. When the pistons 4 is reciprocated in the cylinders 10, refrigerant gas is sucked from a suction chamber 11 into the cylinders 10 and then is discharged therefrom to a discharge chamber 12 with compression thereof.

The swash plate 1 has a peripheral portion on which sliding surfaces 2 are formed to be slidable relative to the sliding members 3, respectively. In other words, the sliding surfaces 2 of the swash plate 1 face on the sliding members 3 with rotation of the swash plate 1. The peripheral portion of the swash plate 1 is formed conical. In other words, each of the sliding surfaces 2 is non-parallel to the reference surface 8. Specifically, each of the sliding surfaces 2 is along a conical shape having a central axis 13 which is perpendicular to the reference plane 8 and intersects the rotation axis 7 or which passes through a cross point where the rotation axis 7 crosses the reference plane 8. As a result, the sliding surfaces 2 of the swash plate 1 become in line contact with the sliding members 3 in radial directions thereof.

Accordingly, there are provided wedge-shaped gaps between the sliding surfaces 2 and the sliding members 3, particularly at a compression side, in a circumferential direction of the swash plate 1. With this arrangement, lubricating oil can favorably enter into the wedge-shaped gaps under any condition.

The wedge-shaped gaps can be easily changed in shape and volume by changing a vertical angle of the conical shape of the sliding surface 2. Thus, the amount and contact pressure of the lubricating oil can be easily adjusted. For example, if the cone angle is increased, the wedge-shaped gaps are reduced in volume so that the amount of lubricating oil entrained in a rotation direction is also reduced, and vice versa.

Since the non-parallel surfaces 2 at both sides of the swash plate 1 are inclined in the same direction, the rotation of the swash plate 1 can be smoothed and an operation thereof becomes excellent even in case of a variable displacement compressor.

Figure 2:
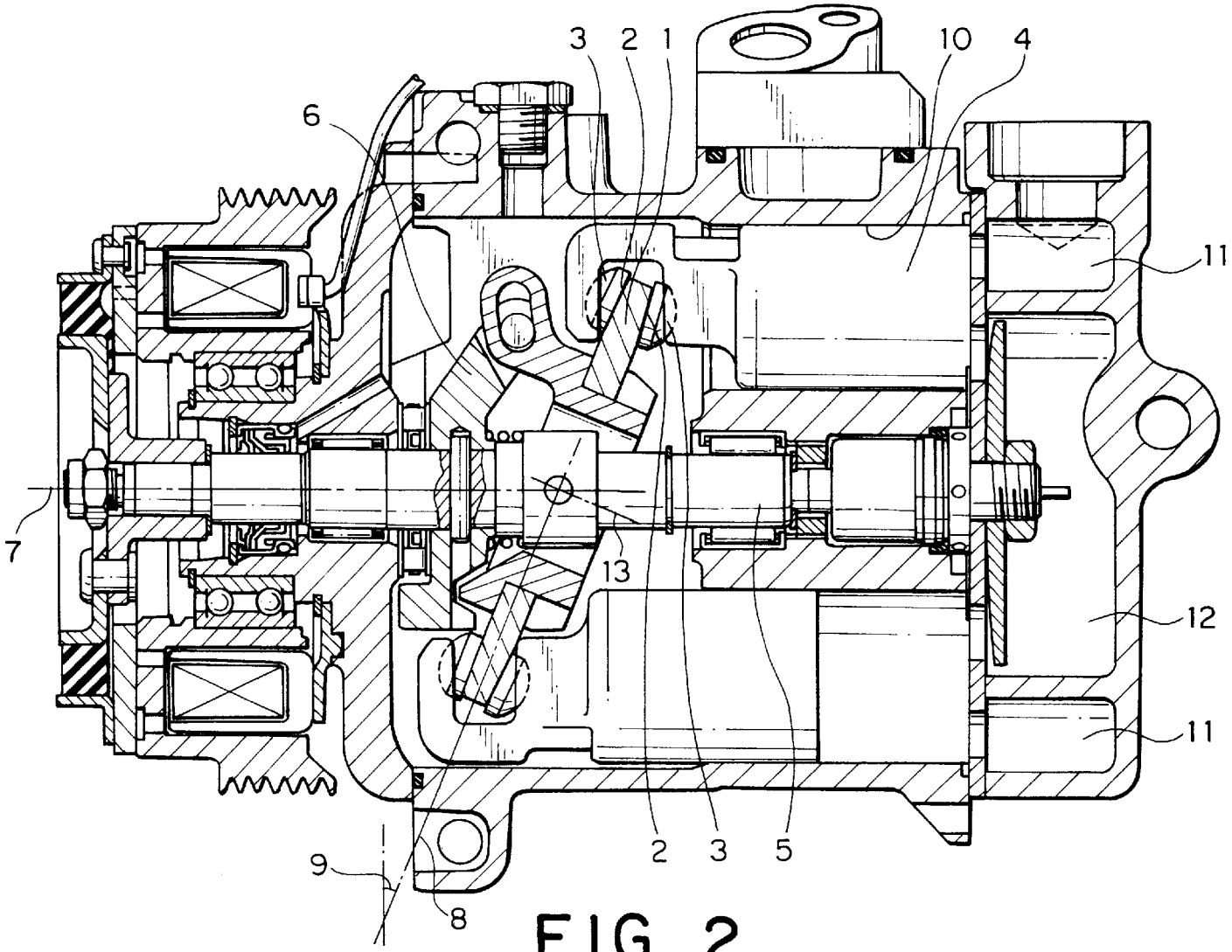
FIG. 2 is a longitudinal sectional view of a swash plate compressor according to a second preferred embodiment of the present invention.
Figure 3:
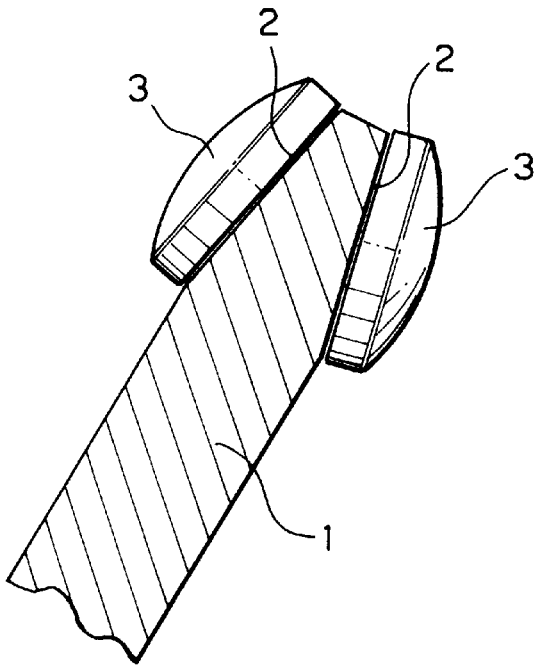
FIG. 3 is a diagram showing the main part of FIG. 2 on an enlarged scale.

Referring to FIGS. 2 and 3, the description will be made as regards a swash plate compressor according to a second preferred embodiment of the present invention. Similar parts are designated by like reference numerals. In the swash plate compressor, the sliding surfaces 2 of the swash plate 1 are along conical shapes, respectively, which direct opposite to each other. Namely, each of the sliding surfaces 2 is non-parallel to the reference surface 8.

It may be arranged that only one of the sliding surfaces 2 at a piston side where compression loads of the pistons 4 are applied is rendered non-parallel to the inclined surface of the swash plate 1.

Since the swash plate 1 is much greater in diameter as compared with the sliding member, the conical shape of the sliding surface 2 can be easily formed using a lathe or the like, and further, various shapes may also be easily achieved. Accordingly, the adjustment of the lubrication can be easily carried out by changing the shape and dimensions of the non-parallel surface of the swash plate.

The cone line of the conical shape is not limited to the straight line, but may be in the form of circle, parabola, ellipse, hyperbola or the like depending on the lubrication efficiency and the motion of the pistons. It is evident that various other shapes may also be adopted as the non-parallel surfaces.

Figure 4:
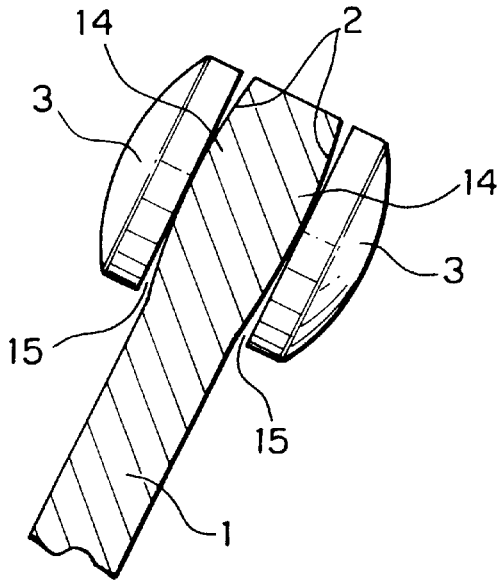
FIG. 4 is a diagram showing a modification wherein sliding surfaces of a swash plate are formed by curved surfaces, respectively.

Referring to FIG. 4 together with FIG. 2, the description will be directed to a modification wherein each of the sliding surfaces 2 of the swash plate 1 is along a curved surface shape. Similar parts are designated by like reference numerals.

The curved surface shape of each of the sliding surfaces 2 curves relative to the reference plane 8 in a radial direction of the swash plate 1 to form convex portions 14 protruded towards the sliding members 3, respectively. Each of the convex portions 14 circularly extends along the peripheral portion of the swash plate 1. Also in this case, wedge-shaped gaps 15 can be obtained between the sliding surfaces 2 and the sliding members 3. The wedge-shaped gap 15 has a size which can be easily changed in shape and size by changing the shape of each of the sliding surfaces 2 so as to achieve optimization.

For adjusting the supply amount of the lubricating oil, the conical shape and the curved surface shape may be combined to form each of the sliding surfaces 2 of the swash plate 1. In this case, the point contact can be achieved between the sliding surfaces 2 and the sliding members 3. Also in this case, since the wedge-shaped gaps are obtained in radial and rotation directions, the lubrication can be accomplished. The sliding surfaces 2 can be readily formed into the conical shape by machining the swash plate 1 itself.

Returning back to FIG. 1, the description will be proceeded. When the swash plate 1 is rotated for compressing the refrigerant gas, one of the sliding members 3 pushes the pistons 4. In this case, since each of the sliding surfaces 2 is along the conical shape, one of the sliding members 3 is raised by a rising angle θ relative to the swash plate 1 so that a component force in a radial direction can be reduced while a corresponding force in an axial direction can be increased.

As appreciated, even in case of the non-parallel surface having the shape of the curved surface, the rising angle θ can also be achieved as in case of the conical shape.

Due to the rise of one of the sliding members 3, a compression force of the pistons 4 is increased to improve the compression efficiency. Further, during the reciprocating motion of the pistons 4, the radial component force having nothing to do with the compression work can be reduced so that vibration, noise, etc. can be reduced by means of the point or line contact at the sliding surfaces.

Further, due to the rise of one of the sliding members 3, the one of the sliding members 3 is prevented from receiving an abrupt force owing to the smooth motion change by means of the inclination of the sliding surfaces 3 of the swash plate 1, so that the vibration caused by the conventional excessive unbalance can be reduced.

In the foregoing embodiments, both sides, that is, the piston side and the side away from the piston side, of the swash plate 1 are formed into the conical shape. On the other hand, it is also possible that the sliding surface is provided only at the piston side. Since the swash plate 1 has a disk shape and a great diameter, the formation of the sliding surfaces can be readily carried out into various shapes with high accuracy. The surface formation can be readily achieved. Further, only the swash plate should be processed.

Further, since the wedge-shaped gap is formed orienting in the rotation direction, the lubricating oil is constantly collected at the line-contact portions of the sliding surfaces 2 due to the rotation of the swash plate 1, so that the lubricating oil can be readily collected so as to be prevented from escaping. Accordingly, the excellent lubrication with reduced contact pressure and load can be accomplished.

Further, since the sliding surfaces 2 of the swash plate 1 is in the form of the non-parallel surface having, for example, the conical shape or the curved surface shape, the contact pressure is reduced so that the smooth sliding with less friction and thus the reduction in driving power can be achieved.

In case where the sliding surfaces 2 of the swash plate 1 has the conical shape, the smooth sliding is ensured and the abrupt operation is suppressed so that the vibration and noise can be largely reduced.

In case where the sliding surfaces of the swash plate 1 has the curved surface shape, the smooth sliding is ensured and the abrupt operation is suppressed so that the vibration and noise can be largely reduced. Further, since the wedge-shaped gaps are similarly formed in the rotation direction to collect the lubricating oil, the excellent lubrication can be accomplished.

Specifically, since the lubricating oil can be easily collected so as to be prevented from escaping, the excellent lubrication with reduced contact pressure and load can be accomplished.

By forming the sliding surface, at the side where the piston compression load is applied, of the swash plate relative to the sliding member to be the non-parallel surface, when the swash plate is rotated to cause a reciprocating motion of the piston for compressing the refrigerant gas, although the sliding member pushes the piston, since the sliding surface of the swash plate is the non-parallel surface, the sliding member is raised by the rising angle θ relative to the swash plate so that a component force in a radial direction can be reduced while a corresponding force in an axial direction can be increased.

Due to the rise of the sliding member, a compression force of the piston is increased to improve the compression efficiency. Further, during the reciprocating motion of the piston relative to the sliding member, the radial component force having nothing to do with the compression work can be reduced so that vibration, noise, etc. can be reduced by means of the point or line contact at the sliding surfaces.

Further, since the radial component force to the piston is reduced, the drive load as well as the power load can be reduced and thus the abrasion of the sliding member and the piston is also prevented.

Further, due to the rise of the sliding member, the sliding member is prevented from receiving an abrupt force owing to the smooth motion change by means of the inclination of the non-parallel surface of the swash plate, so that the vibration caused by the conventional excessive unbalance can be reduced.

As appreciated, the sliding surfaces may be provided on both sides of the swash plate. In this case, the swash plate can rotate more smoothly.

While the present invention has thus far been described in connection with a few embodiments thereof, it will readily be possible for those skilled in the art to put this invention into practice in various other manners. For example, the present invention is applicable not only to a single-head piston swash plate variable displacement compressor, but also to a single-head piston swash plate fixed displacement compressor, and further applicable to a double-head piston swash plate compressor.

What is claimed is:

1. A swash plate compressor for carrying out a compression operation, comprising:

a drive shaft extending along a rotation axis and driven to rotate with respect to said rotation axis;

a swash plate coupled to said drive shaft to be rotated by said drive shaft, said swash plate comprising a conical portion defined by an outer and an inner conical surface which are substantially parallel to each other;

a piston movable in a first and a second direction which are opposite to each other, said piston carrying out said compression operation with being moved in said first direction;

a first sliding member held by said piston and facing said outer conical surface of the swash plate, said outer conical surface pushing said piston towards said first direction through said first sliding member when said swash plate is rotated; and a second sliding member held by said piston and facing said inner conical surface of the swash plate, said inner conical surface pushing said piston towards said second direction through said second sliding member when said swash plate is rotated.

2. The swash plate compressor of claim 1, wherein said conical portion has a central axis intersecting said rotation axis.

3. The swash plate compressor of claim 1, wherein said outer and said inner conical surfaces have convex portions protruded towards said first and said second sliding member, said convex portions circularly extending along said outer and said inner surfaces, respectively.

4. A swash plate compressor comprising:

a drive shaft extending along a rotation axis and driven to rotate with respect to said rotation axis;

a swash plate coupled to said drive shaft to be rotated by said drive shaft, said swash plate having a principal surface and a convex portion which is protruded from said principal surface and circularly extending along said principal surface;

a piston; and a sliding member held by said piston and having a flat surface which is in contact with said convex portion to slide along said convex portion when said swash plate is rotated.

5. The swash plate compressor of claim 4, wherein said convex portion makes a wedge-shaped gap left between said swash plate and said sliding member towards a radial direction of said swash plate.

6. The swash plate compressor of claim 5, wherein said convex portion has a surface smoothly curved in said radial direction.

* * * * *